US010240418B2

(12) United States Patent
Ruttley

(10) Patent No.: US 10,240,418 B2
(45) Date of Patent: Mar. 26, 2019

(54) APPARATUS AND METHOD FOR INNER CASING STRING WINDOW MILLING AND OUTER CASING CEMENT SHEATH REMOVAL

(71) Applicant: ABRADO, INC., Houston, TX (US)

(72) Inventor: David J. Ruttley, Marrero, LA (US)

(73) Assignee: ABRADO, INC., Houston, TX (US)

( * ) Notice: Subject to any disclaimer, the term of this patent is extended or adjusted under 35 U.S.C. 154(b) by 0 days.

(21) Appl. No.: 15/529,166

(22) PCT Filed: Nov. 24, 2015

(86) PCT No.: PCT/US2015/062264
§ 371 (c)(1),
(2) Date: May 24, 2017

(87) PCT Pub. No.: WO2016/085899
PCT Pub. Date: Jun. 2, 2016

(65) Prior Publication Data

US 2017/0356263 A1 Dec. 14, 2017

Related U.S. Application Data

(60) Provisional application No. 62/084,651, filed on Nov. 26, 2014.

(51) Int. Cl.

| | |
|---|---|
| ***E21B 29/00*** | (2006.01) |
| ***E21B 17/10*** | (2006.01) |
| ***E21B 34/06*** | (2006.01) |
| ***E21B 47/09*** | (2012.01) |
| *E21B 34/00* | (2006.01) |

(52) U.S. Cl.
CPC ..... *E21B 29/005* (2013.01); *E21B 17/1021* (2013.01); *E21B 34/06* (2013.01); *E21B 47/09* (2013.01); *E21B 2034/005* (2013.01)

(58) Field of Classification Search
CPC ..... E21B 29/005
See application file for complete search history.

(56) References Cited

U.S. PATENT DOCUMENTS 2,690,897 A * 10/1954 Clark, Jr. ..... E21B 10/322 166/55.8
3,117,626 A * 1/1964 Ringler ..... E21B 29/005 166/55.7
5,012,863 A * 5/1991 Springer ..... E21B 10/46 166/55.7

(Continued)

FOREIGN PATENT DOCUMENTS

WO WO 2014/025763 A2 2/2014

*Primary Examiner* — Shane Bomar
(74) *Attorney, Agent, or Firm* — Law Office of Jesse D. Lambert, LLC

(57) ABSTRACT

A casing mill having a main body with cutter bases with cutters mounted on the cutter bases. The cutter bases are moved radially by operating arms which are rotatably attached to the main body, which are in turn moved by an operating mechanism in response to fluid flow through. One or more of the operating arms are extended to form a cutout arm, which enables cutting an initial window in a casing string, from which milling can continue. The operating arms are mounted to the main body by pins, which are held in the main body by a pin retaining arrangement.

9 Claims, 12 Drawing Sheets

(56) References Cited

U.S. PATENT DOCUMENTS

| | | | | |
|---|---|---|---|---|
| 6,357,528 | B1 * | 3/2002 | Davis | E21B 29/005 166/298 |
| 2005/0133224 | A1 * | 6/2005 | Ruttley | E21B 29/005 166/298 |
| 2013/0199785 | A1 * | 8/2013 | Hekelaar | E21B 23/006 166/298 |
| 2014/0332200 | A1 * | 11/2014 | Ruttley | E21B 29/00 166/55.7 |
| 2016/0130900 | A1 * | 5/2016 | Cronley | E21B 29/005 166/298 |

* cited by examiner

APPARATUS AND METHOD FOR INNER CASING STRING WINDOW MILLING AND OUTER CASING CEMENT SHEATH REMOVAL

CROSS REFERENCE TO RELATED APPLICATIONS

This application claims priority to U.S. Provisional patent application Ser. No. 62/084,651, filed Nov. 26, 2014, for all purposes. The disclosure of that application is incorporated herein by reference, to the extent not inconsistent with this disclosure.

BACKGROUND

Field of the Invention

This invention relates to apparatus used to cut sections of tubulars, downhole in a wellbore, in addition to other actions such as cement and formation removal.

SUMMARY OF THE INVENTION

A main body has an operating mechanism which uses fluid flow to rotate one or more operating arms from an first, retracted position (essentially within the main body), to a second extended position, rotated outwardly from the main body. Attached to the operating arms are at least two elongated cutter/stabilizer bases, which move radially outward as the operating arms rotate outward, and are held substantially parallel to the main body as they move radially outward.

A section of the cutter/stabilizer bases proximal the lower (downhole) end of same has no cutters mounted on it, forming a stabilizer section. Cutters are mounted on the cutter/stabilizer bases above this stabilizer section. The cutters are generally longitudinally extended along the cutter/stabilizer bases, and preferably rather long, for example as long as about 18". The cutters extend radially outward a sufficient dimension beyond the outermost surface of the cutter/stabilizer bases to remove the desired tubular material, for example to the outer diameter of the casing collars of the casing string being milled.

Sections of the uppermost operating arms may overlap the cutter/stabilizer bases, such that the uppermost operating arms extend to a larger radius than the cutter/stabilizer bases when the tool is opened, forming cutout arms. The outermost tips of such cutout arms can therefore be used as "locator" tips, to detect the gaps between successive casing tubes. The cutout arms can then be used to make initial cuts through the casing, and to mill a relatively short "entrance" window in the casing. A combination of rotation speed and weight can then be used to rapidly wear away a portion of the cutout arms, to a maximum outer radius no greater than the inner diameter of the inner casing string at which time the tool can be lowered into the casing string below.

Pins, fitted in holes in the main body, provide the structure on which the operating arms rotate. The present invention comprises a novel pin retainer arrangement. The pin retainer arrangement uses pin retainer keys, which fit into matching recesses near the outermost edge of the pin holes in the main body. The retainer keys are held radially fixed (i.e. prevented from coming out of the recesses) by a disc-shaped retainer key locking sleeve, which in turn is held in place by a retaining screw that screws into the outermost end of the pin.

A roll pin inserted through the locking sleeve into the pin keeps the locking sleeve rotationally locked with the pin.

A jet sub may be placed in the drillstring immediately above the casing cutting tool, to direct a portion of the overall drilling fluid stream into the annulus and onto the operating arms and cutter/stabilizer bases. The jet sub may include a check valve, which may be a poppet, flapper, plunger or other type of check or one-way valve.

DESCRIPTION OF THE PRESENTLY PREFERRED EMBODIMENT(S)

With reference to the drawings some of the presently preferred embodiments can be described.

Figure 1:
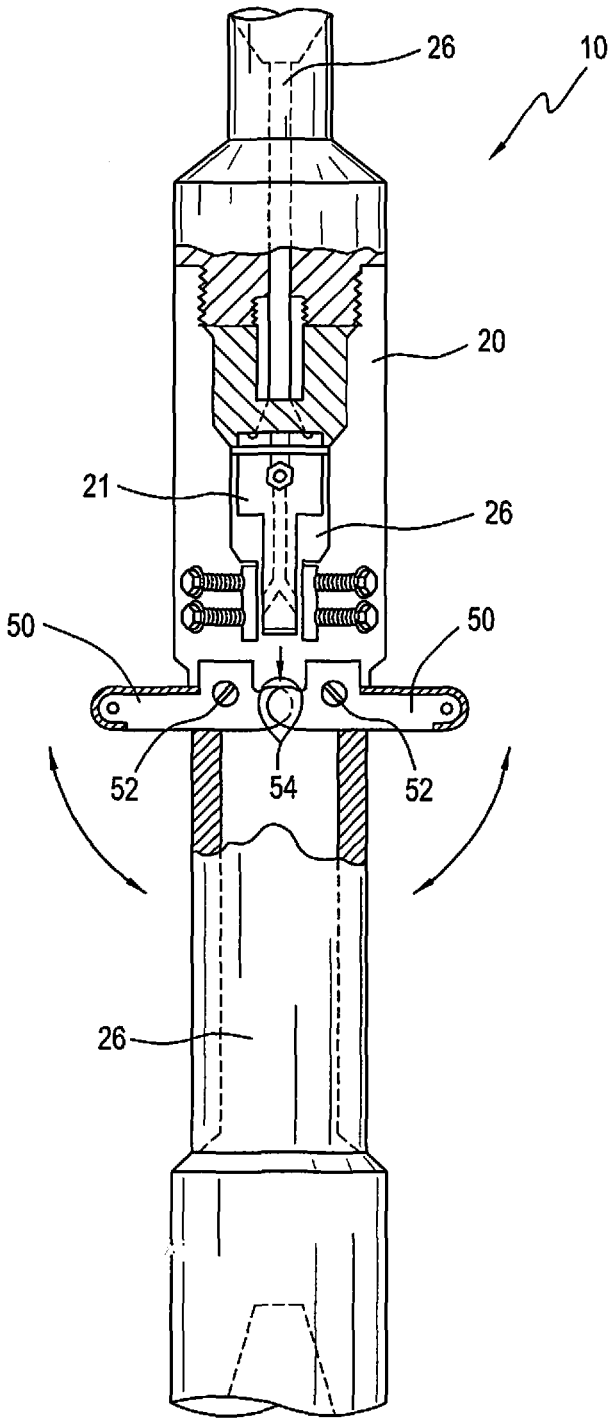
FIG. 1 is a cross section view of the main body and operating mechanism of one embodiment of the tool, showing an operating arm 50.
Figure 2:
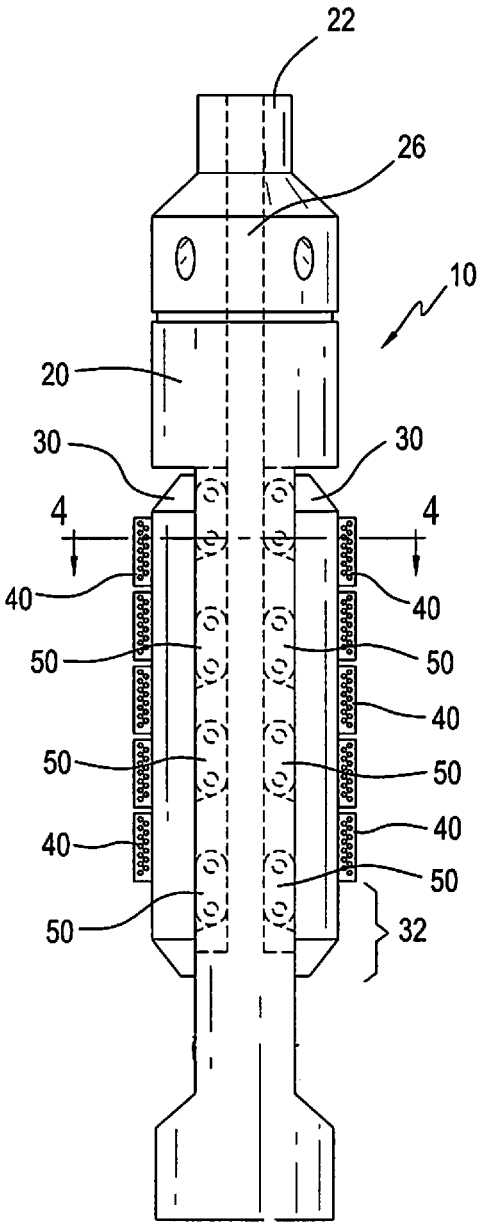
FIGS. 2 and 3 show closed and open positions of an exemplary embodiment of the cutting tool.
Figure 3:
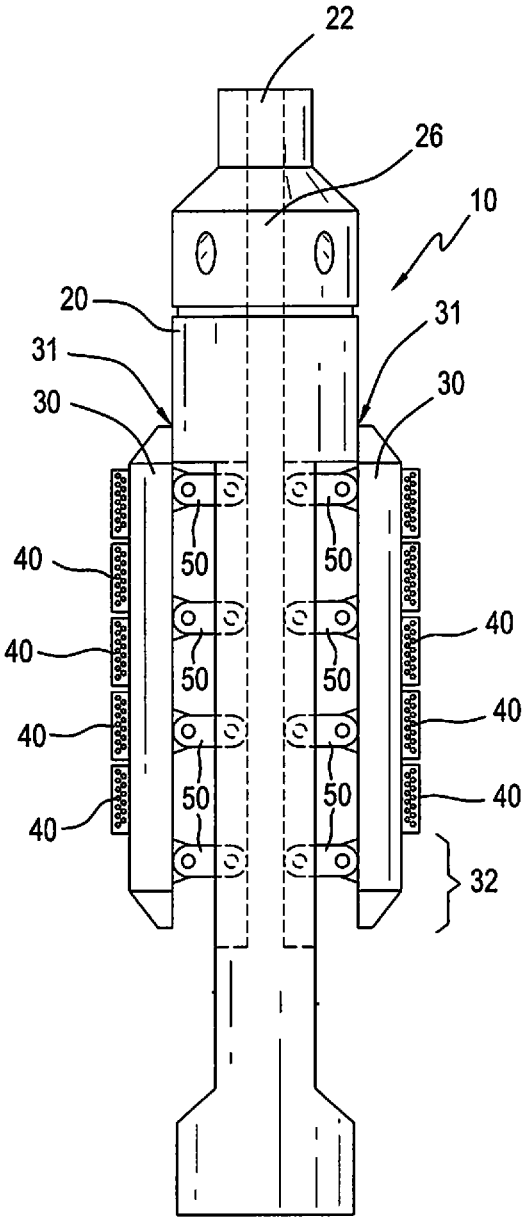

FIG. 1 is a cross section view of an embodiment of the casing cutting tool 10. A main body 20 has a means for moving operating arms 50 outwardly (namely, rotating them outwardly), said means may comprise an operating mechanism within, with a piston 21 positioned in bore 26 responding to fluid flow and bearing on heel portions 54 of operating arms 50. U.S. Pat. No. 7,063,155, owned by the owner of this application, discloses one type of suitable fluid-driven operating mechanism, and the disclosure of that patent is incorporated herein by reference, to the extent necessary to disclose an exemplary operating mechanism. In this example, the operating mechanism rotates a pair of operating arms 50 outward, which may be the uppermost pair of operating arms 50. A plurality of operating arms 50 are provided, spaced longitudinally down the tool, as can be seen in FIGS. 2 and 3. All of the operating arms 50 are rotatably attached to main body 20, by pins 52 inserted through aligned holes in one end of each positioning arm and in the main body. The pins are retained within the main body by a pin retainer system described in more detail below.

It is understood that the operating mechanism may alternatively be a rack and pinion type mechanism, where the operating piston has a rack gear engaging circular gears on the ends of the uppermost operating arms.

Operating arms 50 carry a plurality of elongated cutter/stabilizer bases 30. Since operating arms 50 are all of substantially the same length, it can be appreciated that when uppermost operating arms are rotated outwardly, cutter/stabilizer bases 30 all move radially outward, remaining substantially aligned with main body 20 of the tool. The length of operating arms 50, and the thickness dimension of cutter/stabilizer bases 30, are such as to enable cutter/stabilizer bases to bear against the inner wall of the inner casing string in which the tool is deployed. As is described in more detail below, a single set of operating arms 50 may permit use of cutting tool 10 in multiple casing diameters.

Cutters 40 are mounted on cutter/stabilizer bases 30. Cutters may be of different designs, generally all comprising some sort of hardened cutting material, which may be carbide, carbide buttons, polycrystalline diamond compact disks, or other hardened cutting surfaces known in the relevant art. Preferably, cutters 40 have a relatively long longitudinal dimension or length, for example as long as 18". As later described, due to the manner of cutting this dimension enables uninterrupted cutting of relatively long windows in the casing string.

Figure 4:
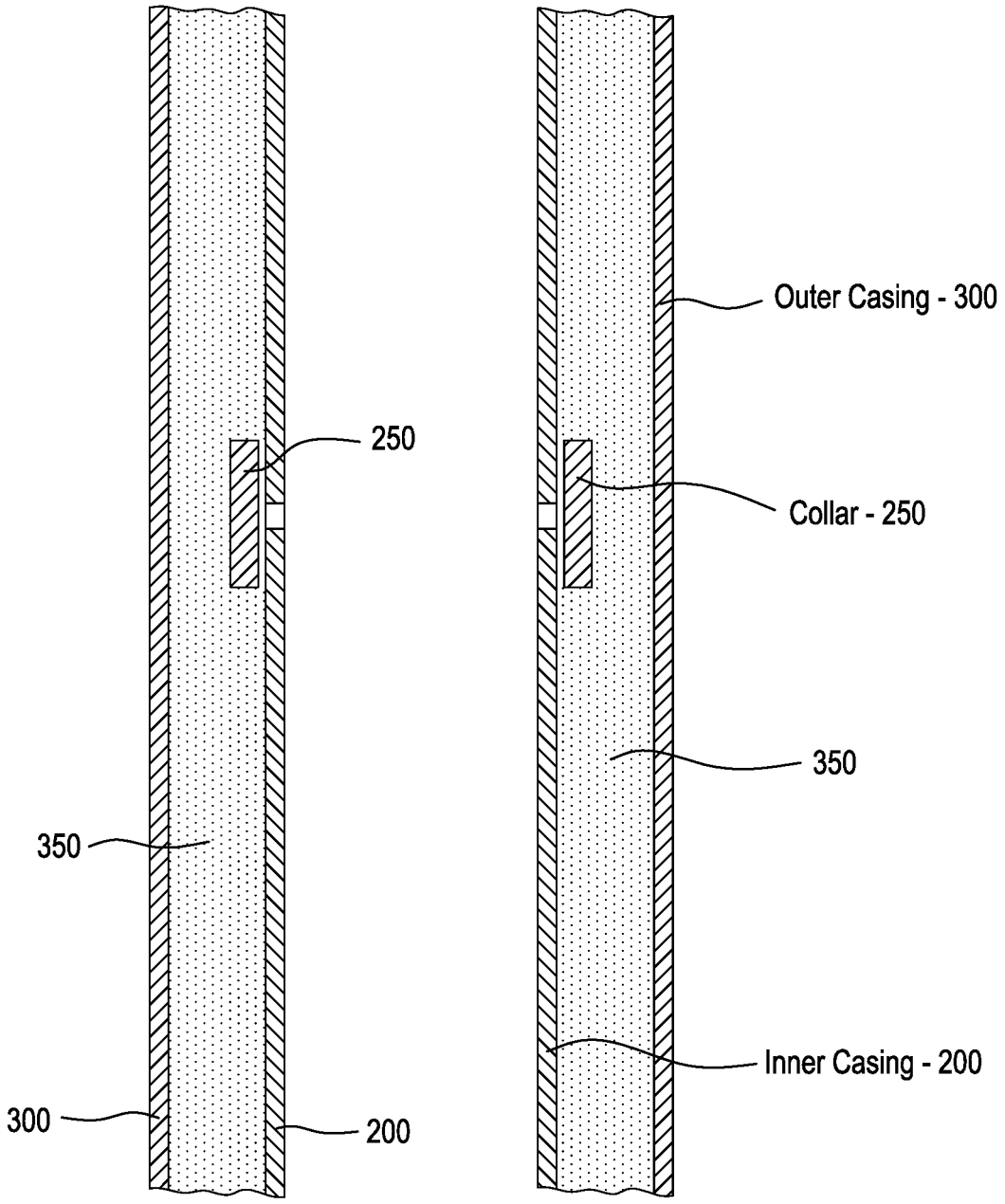
FIG. 4 shows an example of inner and outer casing strings in a wellbore, with a cement sheath between the casing strings.
Figure 5:
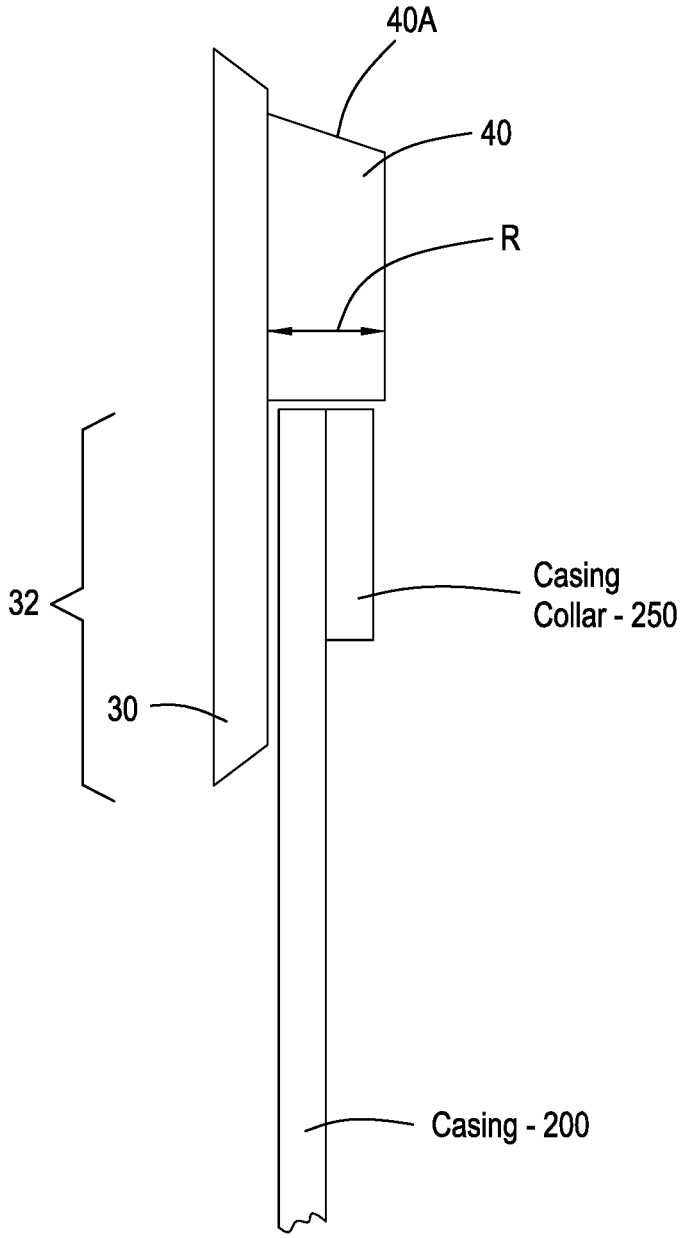
FIG. 5 shows certain elements of the tool of the present invention, namely the stabilizer section of the cutter/stabilizer base against the inner wall of the inner casing string, and the radial extent of the cutter.

FIGS. 4 and 5 show certain aspects of the setting in which the tool is typically run, and the interaction between the cutter/stabilizer bases, cutters, and tubular being milled. FIG. 4 shows an example of inner casing 200 and outer casing 300 strings, a casing collar 250 joining joints of the inner casing string 200, and a cement layer 350 between the casing strings. Referring to FIG. 5, the radial dimension "R" of cutters 40, beyond the outermost face of cutter/stabilizer bases 50, is of importance. Preferably, this radial dimension R is large enough to extend to, and slightly beyond, the maximum expected expected tubular outer diameter, which typically is the casing collar, as can be seen in FIG. 5. It can be readily understood, and will be explained in more detail below, that when the tool is in operation, cutter/stabilizer bases 30, and more specifically the radial outward face thereof, bear against the inner wall of the inner casing string. Cutters 40 therefore extend radially outward from the outermost face of the cutter/stabilizer bases, as noted above a sufficient distance to extend to the outermost tubular diameter to be cut (which may be the casing collar outer diameter). While the cutter radial dimension "R" can be varied to suit particular applications, it has been found that a cutter radial dimension of approximately 1⅛" will cover a large number of casing wall thickness/collar thickness combinations. At the same time, cutter radial dimension "R" is small enough that it will not contact the inner wall of the outer casing string.

Preferably, the outermost face of cutters 40 is non-cutting; that is, contact with the casing wall by the outermost cutting face will not result in a cutting of the casing wall. For example, the outermost face of cutters 40 may be a smooth, hardened steel surface. In addition, if desired, the uphole shoulder 40A of the cutters may be angled, as can be seen in FIG. 5, to assist in pulling the tool uphole after a job, and to assist in cutting formation and/or cement.

Figure 6:
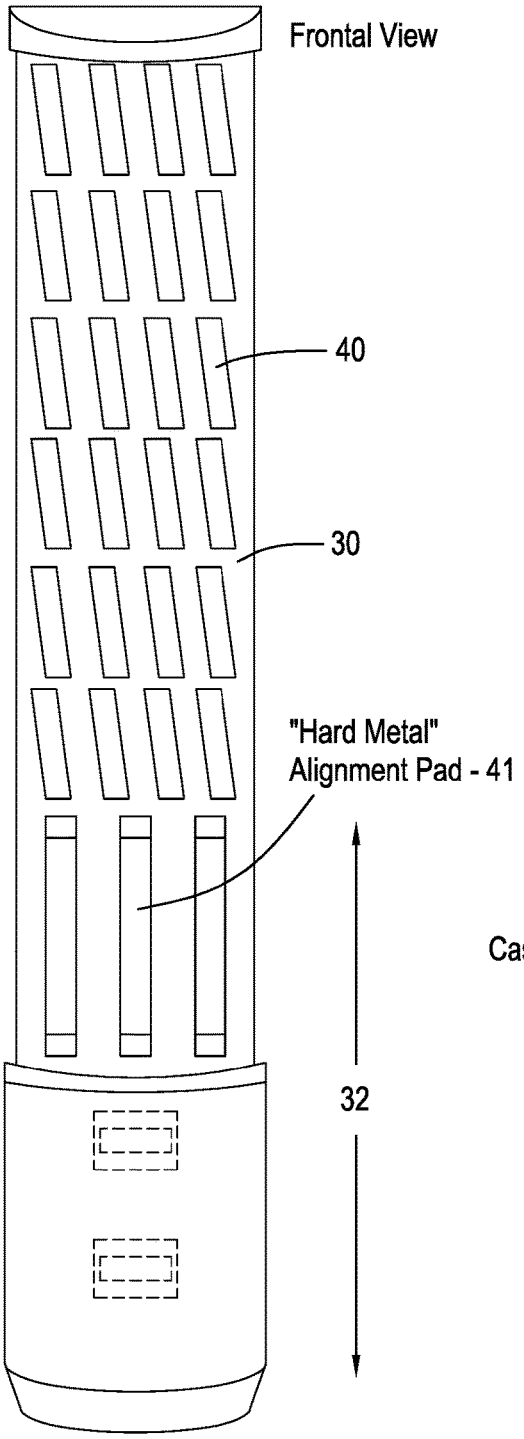
FIGS. 6 and 7 show further detail of the cutter/stabilizer bases and cutters, in place within a casing string.
Figure 7:
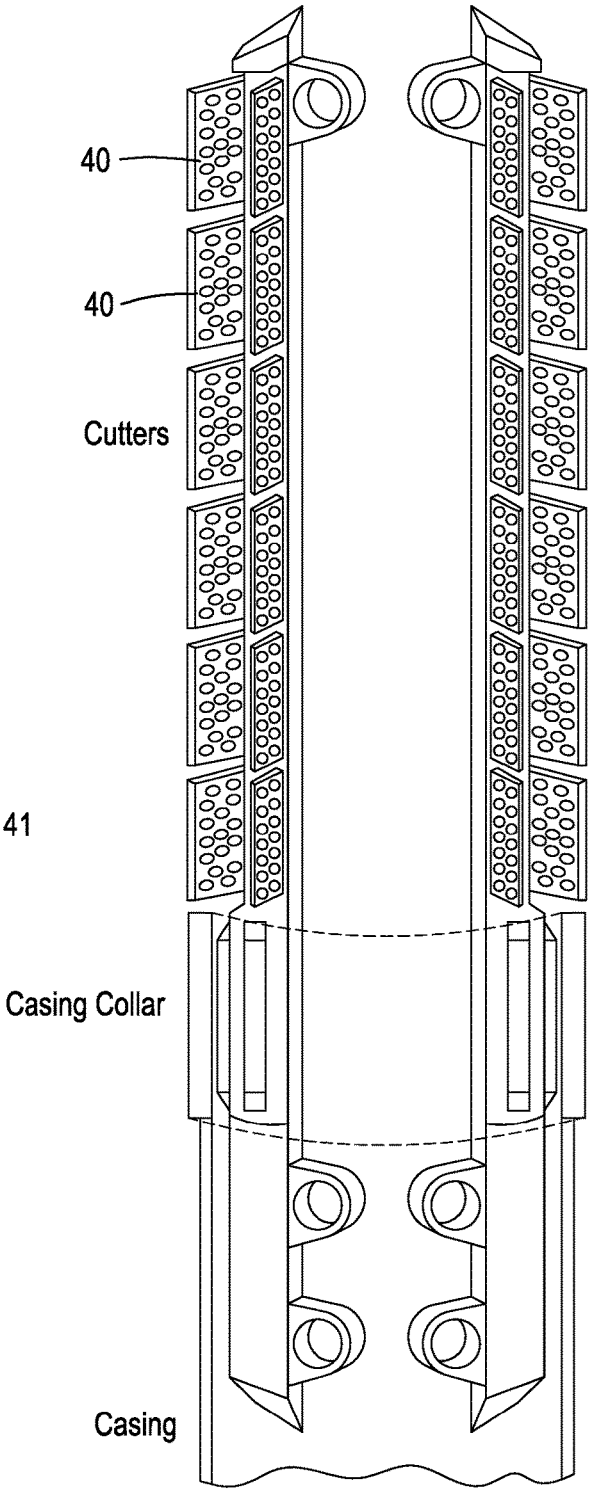

As can be seen in the figures, a stabilizer section 32 of cutter/stabilizer bases 30 has no cutters 40 mounted on it, providing a means for bearing against the inner wall of the casing string and providing a stabilizing means for the cutting tool, and especially the cutters. FIGS. 6 and 7 show additional detail of cutter/stabilizer bases 30 and cutters 40, relative to a casing string. A hard metal, non-cutting alignment pad 41 may be mounted in stabilizer section 32.

Figure 10:
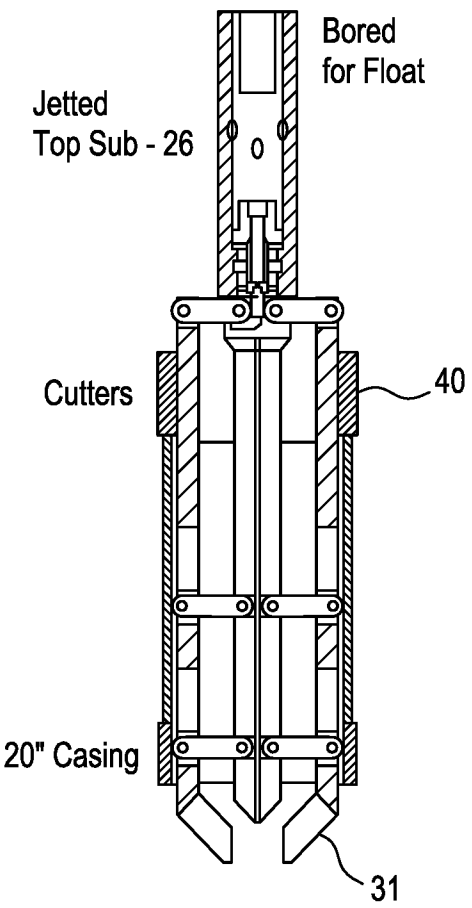
FIGS. 8-10 show the cutting tool engaged in three different casing string diameters.
Figure 9:
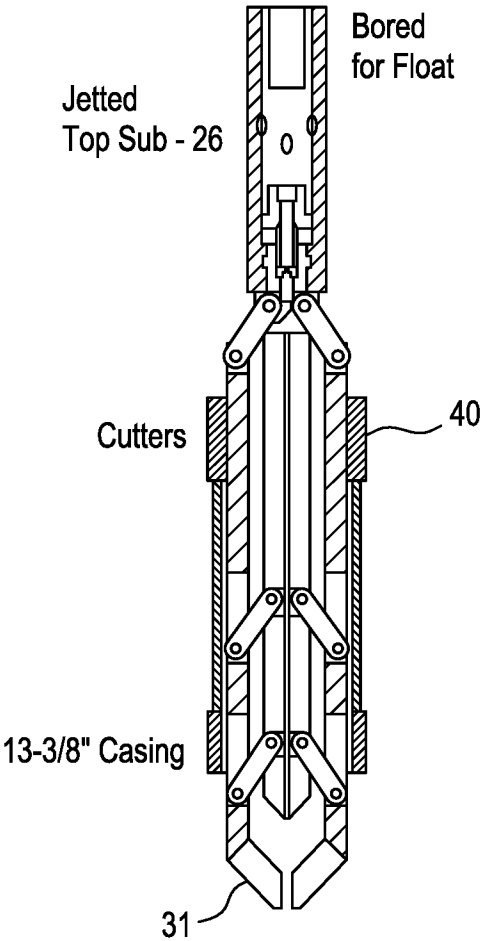
Figure 8:
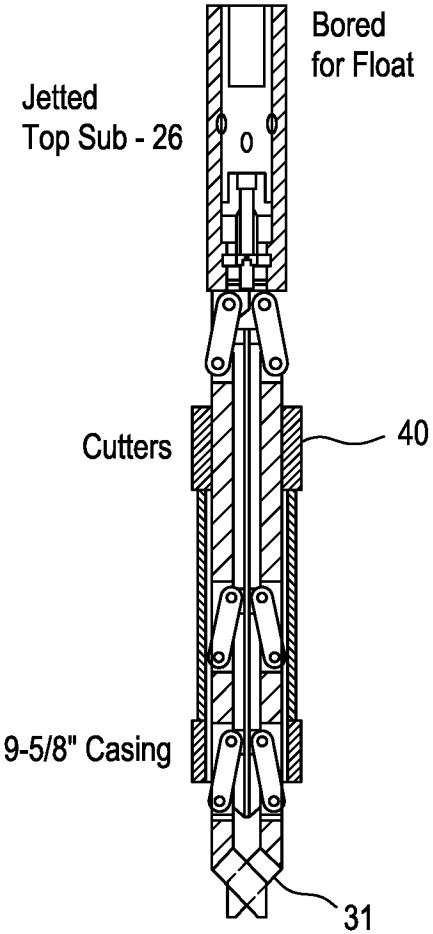

It will be understood from the above description that multiple casing diameters may be milled, without changing the operating arms, cutter/stabilizer bases, or cutters, since the tool always opens up to its maximum possible diameter—namely, to the point that the stabilizer section 32 of the cutter/stabilizer bases 30 bears against the inner wall of the inner casing string 200. As can be seen by FIGS. 8-10, for three exemplary casing diameters (9⅝", 13⅜", and 20"), the tool opens to its maximum allowable diameter for the given casing diameter, and therefore always positions the cutters 40 properly over the uppermost casing stub edge. A lower end 31 of cutter bases 30 may be angled to form a cutting/alignment nose, as seen in FIGS. 8-10.

Figure 11:
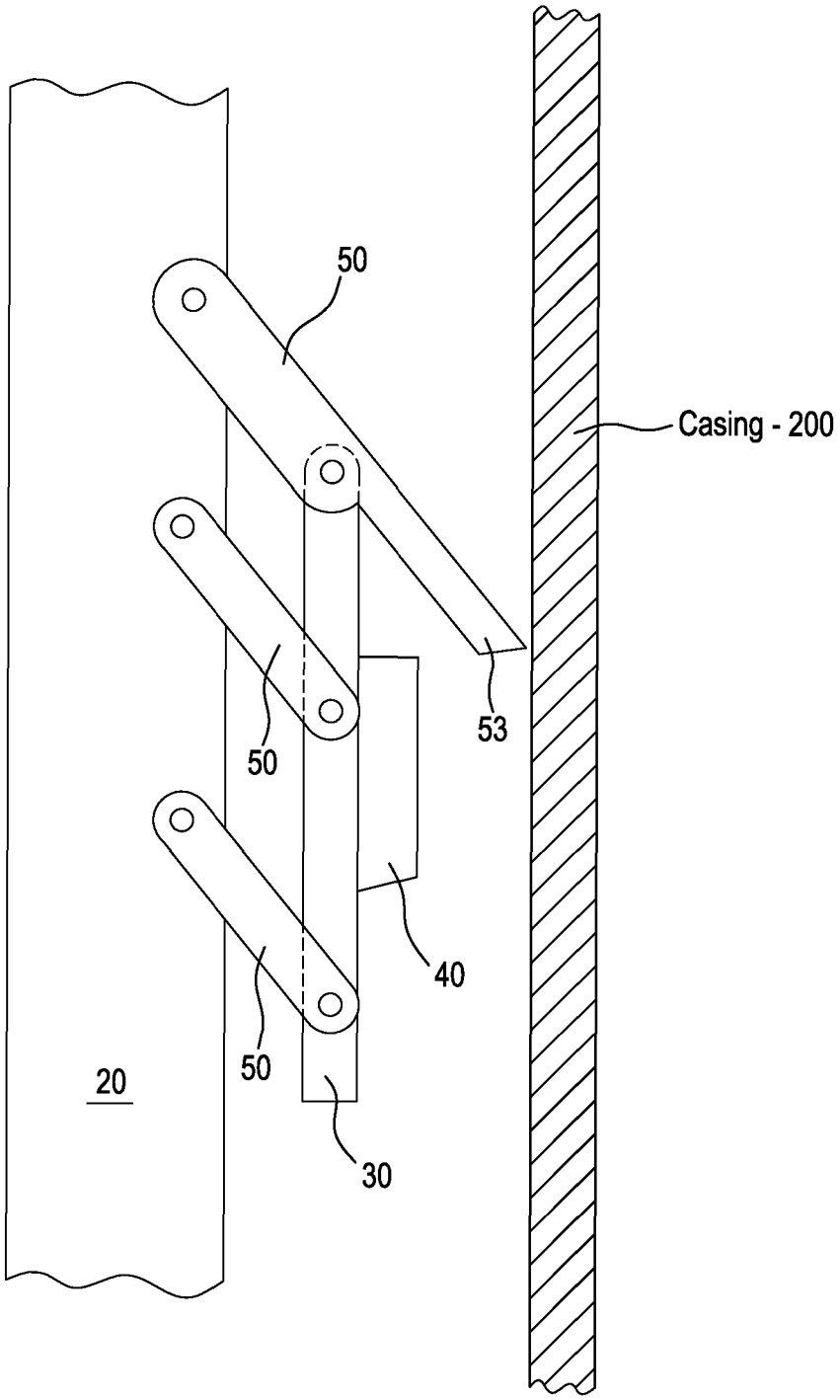
FIG. 11 shows a cutout arm arrangement.
Figure 12:
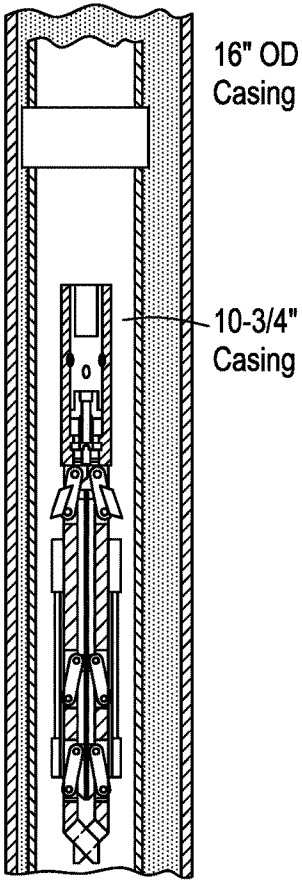
FIGS. 12-15 show a casing cutout/milling sequence.
Figure 13:
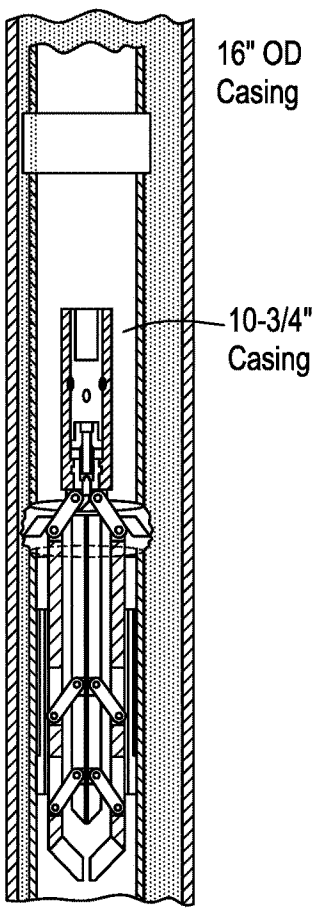
Figure 14:
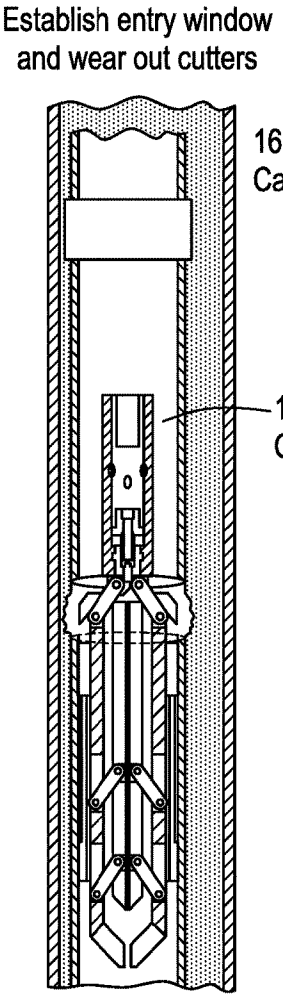

In some embodiments of the tool, an initial cutout arm is provided, to enable cutting out of the initial casing window and mill a relatively short section of casing, to provide a window for cutters 40 to be employed for the primary milling function. Referring to FIG. 11, cutout arm 53 may be formed as an extension of uppermost operating arm 50, or some other suitable configuration. As can be seen in FIG. 11, by extending the dimension or length of uppermost operating arm 50 as shown, when the tool is opened cutout arm 53 extends to a greater radial dimension than cutters 40 on the cutter/stabilizer base 30, hence contact the casing wall first, while cutters 40 are still spaced away from the casing wall. As is described below, the length of the cutout arms 53 in excess of the inner diameter of the inner casing string 200 may be removed or "burned away" in the overall casing window cutting process. FIGS. 16-19, addressed below in more detail, provide further explanation of this procedure.

Method of Use of the Tool

A sequence of use of the tool can now be described. As noted above, FIG. 4 is a cross section view of a typical wellbore, showing inner and outer casing strings. In this drawing, a layer of cement is between the casing strings. The collar joining two joints of casing, in the inner casing string, is shown. A gap between the ends of the tubes of the two joints in the inner casing string can be seen.

Figure 15:
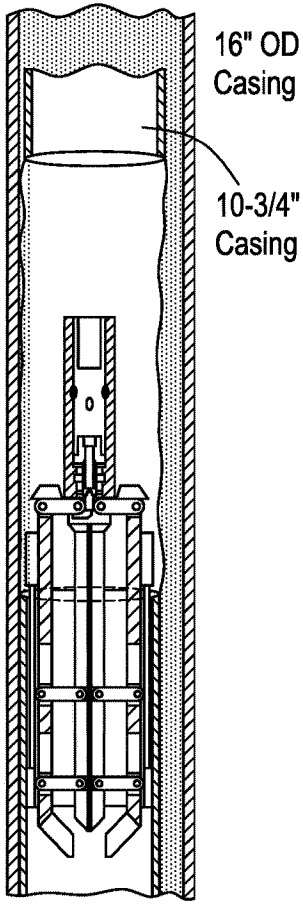
Figure 19:
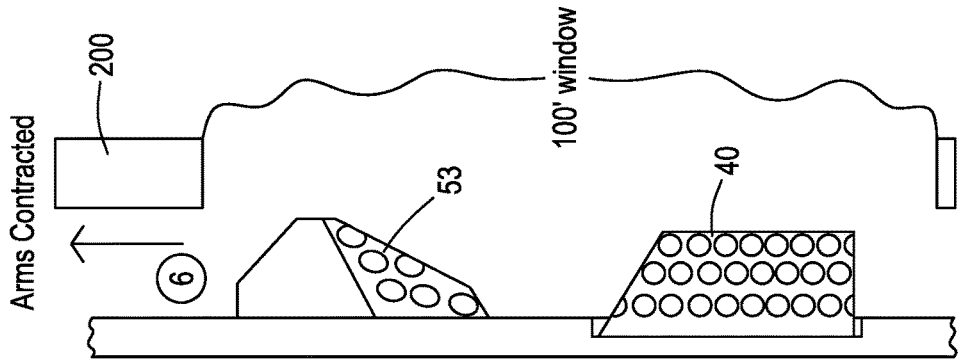
FIGS. 16-19 are additional views of a casing cutout/milling sequence.
Figure 18:
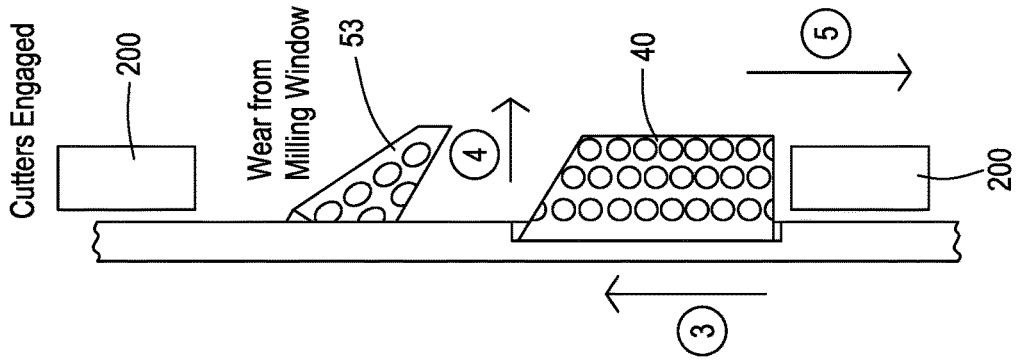
Figure 17:
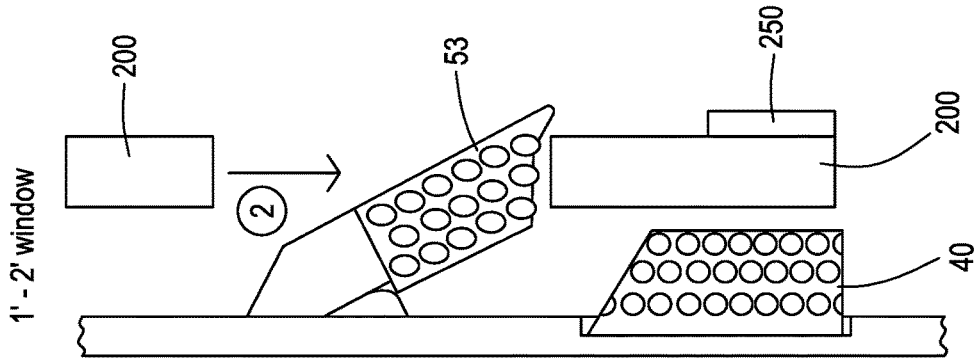
Figure 16:
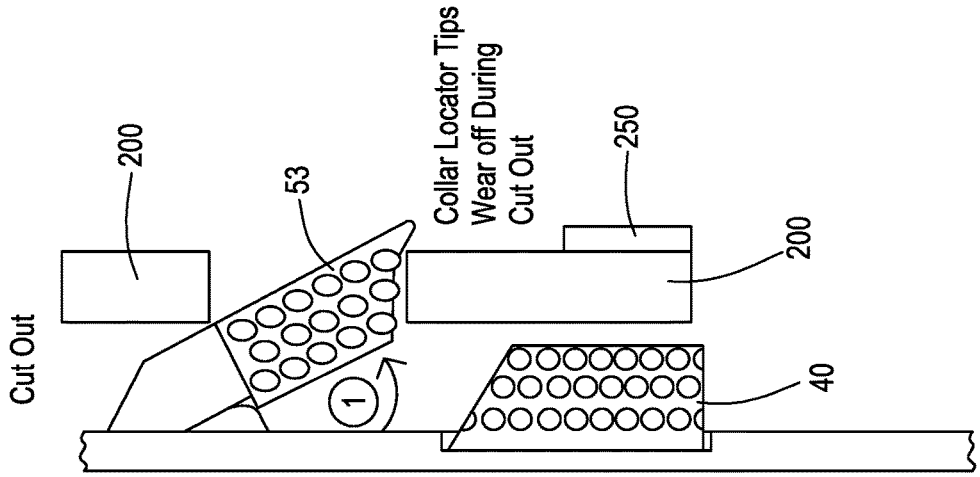

Referring to FIGS. 12-15, one possible sequence of use of the tool comprises the steps of:

- positioning of tool at a desired depth in a wellbore (FIG. 12)
- commence fluid flow to cause tool to open sufficiently for the cutout arms to contact the inner wall of the casing string
- if applicable, lowering of tool so that the ends of the cutout arms contact the casing tube gap, and verify depth of the gap (and the top of the casing collar)
- pick the tool up to the desired depth, and with fluid flow ongoing commence rotation and cutting into casing by the cutout arms (FIG. 13)
- once operational indications of full penetration of the casing wall are noted (changes in fluid flow, string weight, torque, etc.), lower the tool to cut desired entry window length (FIGS. 13 and 14)
- upon achieving the desired entry window length, increase weight/rotational speed to accelerate wear-out of the cutout arms (i.e. "burning off" of the cutout arms) to a dimension no greater than the inner diameter of the casing string, noting a "drop" of the tool into the inner casing stub to signify same (FIGS. 13 and 14)
- positioning of tool with the stabilizer section of cutter/stabilizer base in casing stub, with the cutters above casing stub, as in FIG. 15
- commence lowering of the tool with ongoing fluid circulation and rotation, with the stabilizer section of the cutter/stabilizer base bearing against the inner wall of casing stub, and the cutters milling the casing (and casing collar, or any other material such as cement or formation) out to the full reach of the cutter radial dimension (FIG. 15)

continue cutting process until completion of desired section length (FIG. 15)

pick up tool above milled section, circulate out as needed with the tool positioned within the milled-out section, and circulation ongoing, the tool will be opened to its full extent (as permitted by outer casing string);

commence pulling out of the hole with ongoing circulation and rotation, thereby removing any cement sheath from the inner wall of the outer casing string, and any formation, while the tool is being pulled out of the hole when the desired length of casing window is cleaned, circulate out as necessary, pull out of the hole with the tool FIGS. 16-19 provide further description of this exemplary procedure.

Additional Structural Aspects of Some of the Preferred Embodiments

Figure 20:
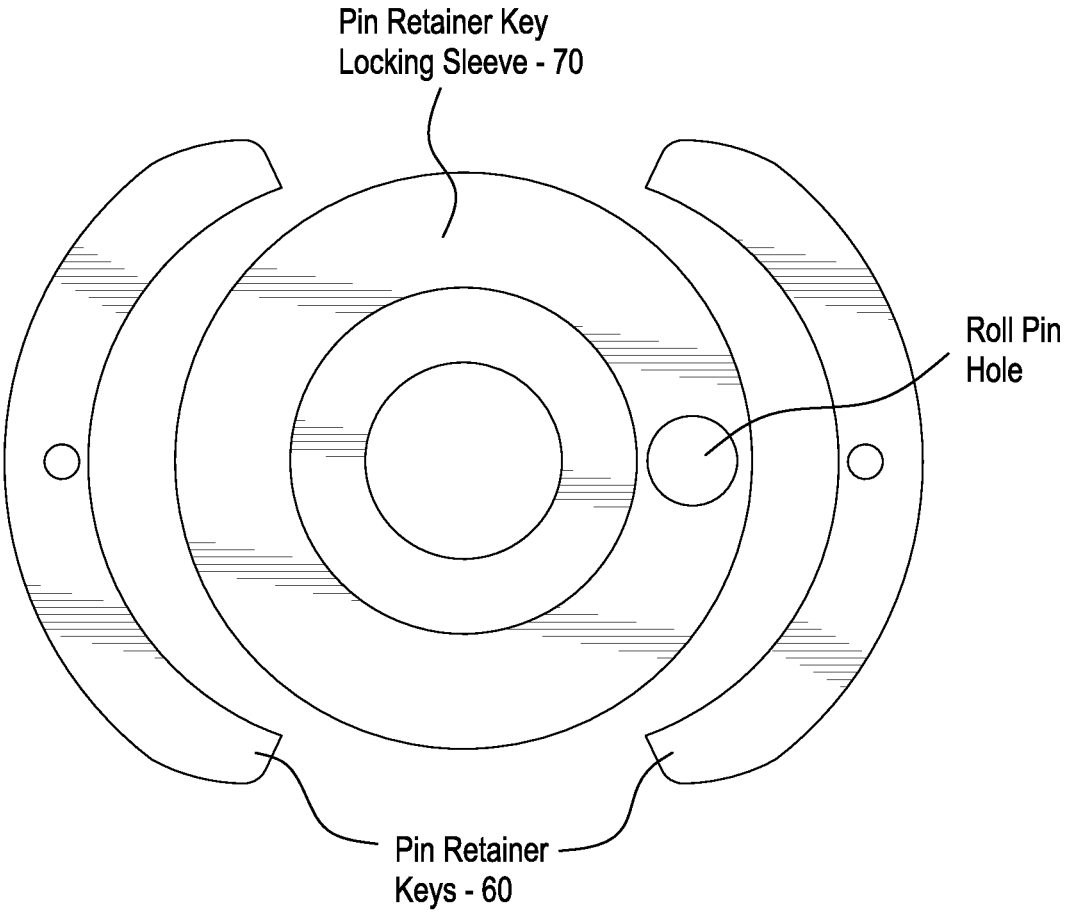
FIGS. 20 and 21 show various aspects of the pin assembly.
Figure 21:
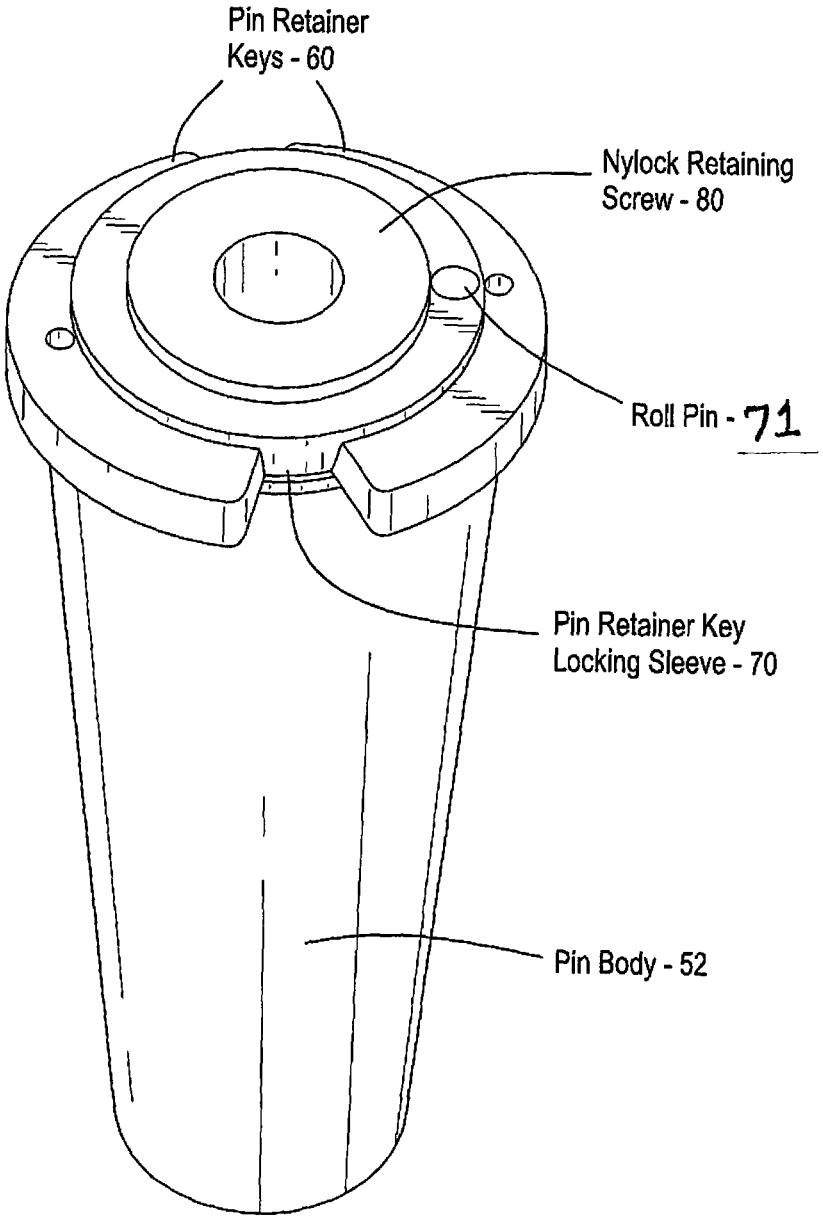
Figure 22:
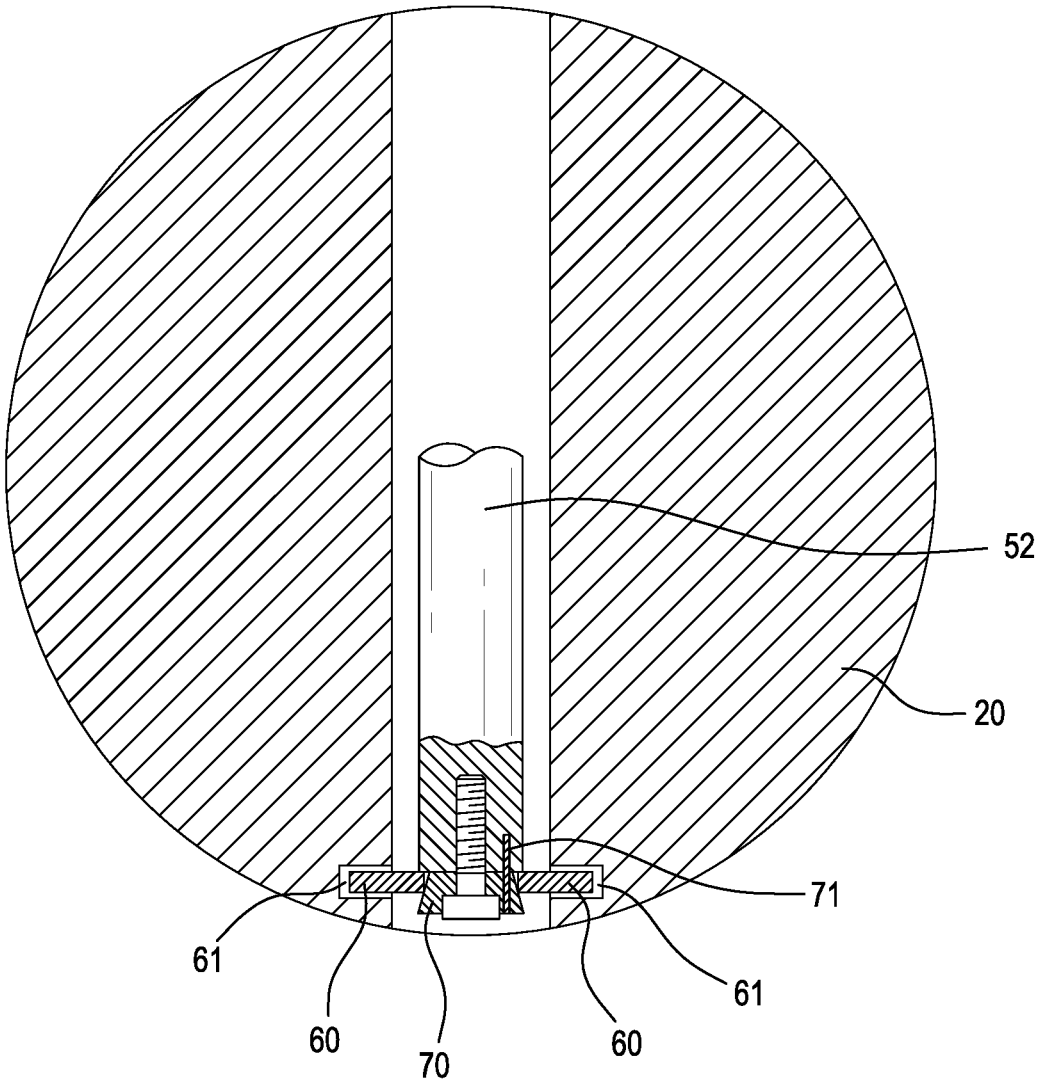
FIG. 22 is a cross section view of the pin assembly, viewed down the longitudinal axis of the tool.

Pins 52 in main body 20 provide the structure on which the operating arms rotate. The present invention comprises a novel pin retainer arrangement. Referring to FIGS. 20 and 21 (FIG. 20 showing the pin retainer keys and pin retainer key locking sleeve, and FIG. 21 showing the pin retainer keys, pin retainer key locking sleeve, retaining sleeve with roll pin hole, and retaining screw, all in place on a pin), the pin retainer arrangement uses a pair of generally crescent shaped pin retainer keys 60, which fit into matching recesses 61 near the outermost edge of the pin holes in main body 20. As can be seen in FIG. 22, which is a cross section view of the pin arrangement within main body 20 the retainer keys cover a portion of the radial outward face of pin 52. In this position, retainer keys 60 cannot move radially outward, hence block movement of pin 52 and keep it from moving radially outward. Retainer keys 60 are held fixed (i.e. prevented from moving toward one another, and thereby coming out of the recesses 61) by a disc-shaped retainer key locking sleeve 70, which in turn is held in place by a retaining screw 80 that screws into the outermost end of pin 52. The retaining screw 80 preferably is self-locking, e.g. having a Nylok insert, and in addition a thread locking compound may be applied to retaining screw 80. A roll pin 71 inserted through the locking sleeve (namely, through roll pin hole) into pin 52 keeps locking sleeve 70 rotationally locked with pin 52.

As can be seen in FIGS. 8-10 and 12-15, a jet sub may be placed in the drillstring immediately above the casing cutting tool, to direct a portion of the overall drilling fluid stream into the annulus and onto the operating arms and cutter/stabilizer bases. The jet sub may include a check valve, which may be a poppet, flapper, plunger or other type of check or one-way valve.

Conclusion

While the preceding description contains many specificities, it is to be understood that same are presented only to describe some of the presently preferred embodiments of the invention, and not by way of limitation. Changes can be made to various aspects of the invention, without departing from the scope thereof.

Therefore, the scope of the invention is to be determined not by the illustrative examples set forth above, but by the appended claims and their legal equivalents.

I claim:

1. A casing mill adapted for placement in a drillstring, comprising:

an elongated main body having a bore;

a plurality of elongated cutter bases hingedly connected to said main body by a plurality of operating arms and movable between a first position substantially retracted to said main body, and a second position extended outwardly from said main body;

one or more cutters mounted on each of said cutter bases, said cutters positioned so as to be in cutting relationship with a casing string when said cutter bases are in said second position; wherein each of said cutter bases comprises a stabilizer section on a lower end thereof, wherein no cutters are mounted, said stabilizer section adapted to bear against an inner wall of a casing string when said cutter bases are in said second position;

a radial dimension of said cutters extending outwardly from said cutter base and beyond an outer diameter of said casing string, when said stabilizer bears against said inner wall of said casing string, a sufficient distance to extend over any casing collar on said casing, and wherein a radial outward face of said cutter comprises a non-cutting surface;

wherein one or more of said operating arms comprises an extended cutout arm which extends beyond the radial outermost position of said cutters when said cutter bases are in said second position, so that an outer end of said cutout arm contacts said inner wall of said casing string while said cutters are not in contact with said inner wall, said cutout arm comprising a hardened cutting surface to enable cutting through said casing; and a means for moving said cutter bases between said first and second positions.

2. The casing mill of claim 1, wherein said means for moving said cutter bases between said first and second positions comprises:

a piston disposed in said bore of said main body, and movable in a downhole direction by fluid flow through said bore, said piston bearing on heel portions of said operating arms and rotating said operating arms outwardly, in turn moving said cutter bases radially outward.

3. The casing mill of claim 2, wherein said stabilizer section comprises a plurality of alignment pads mounted thereon.

4. The casing mill of claim 3, wherein said operating arms are mounted on said main body by a plurality of pins inserted in holes in said main body, wherein said main body comprises recesses near the outermost edges of said holes, said pins retained in said main body by a pin retainer comprising:

a pair of crescent shaped retainer keys which fit into said recesses and cover a part of an outer face of a pin inserted in one of said holes, said recesses preventing said retainer keys from moving radially outward;

a disc-shaped locking sleeve positioned over said outer face of said pin, said locking sleeve keeping said retainer keys displaced radially outward in said recesses, said locking sleeve fixed to said pin by a retaining screw; and a roll pin inserted through said locking sleeve into said pin, thereby rotationally locking said locking sleeve and said pin.

5. The casing mill of claim 4, wherein said cutter extends between about ¾" and 1½" from said cutter base.

6. The casing mill of claim 5, wherein said cutter extends about 1⅛" from said cutter base.

7. A method for milling sections of a casing string, comprising the steps of:

a. providing a casing mill adapted for placement in a drillstring, comprising:

an elongated main body having a bore;

a plurality of elongated cutter bases hingedly connected to said main body by a plurality of operating arms and movable between a first position substantially retracted to said main body, and a second position extended outwardly from said main body;

one or more cutters mounted on each of said cutter bases, said cutters positioned so as to be in cutting relationship with a casing string when said cutter bases are in said second position, said cutters at least partially covered in a hardened cutting material;

wherein each of said cutter bases comprises a stabilizer section on a lower end thereof, wherein no cutters are mounted, said stabilizer section adapted to bear against an inner wall of a casing string when said cutter bases are in said second position;

a radial dimension of said cutters extending outwardly from said cutter base and beyond an outer diameter of said casing string, when said stabilizer bears against said inner wall of said casing string, a sufficient distance to extend over any casing collar on said casing, and wherein a radial outward face of said cutter comprises a non-cutting surface;

wherein one or more of said operating arms comprises an extended cutout arm which extends beyond the radial outermost position of said cutters when said cutter bases are in said second position, so that an outer end of said cutout arm contacts said inner wall of said casing string while said cutters are not in contact with said inner wall, said cutout arm comprising a hardened cutting surface to enable cutting through said casing; and a means for moving said cutter bases between said first and second positions, said means for moving responsive to fluid pumped through said main body;

b. lowering said casing mill on a drillstring into a wellbore to a desired position within said wellbore;

c. pumping fluid through said drillstring and said main body, thereby causing said means for moving said cutter bases between said first and second positions to move said operating arms and said cutter bases outwardly until said cutout arm contacts said casing;

d. rotating said casing mill while continuing pumping fluid therethrough, whereby said cutout arms cut through said casing string and creating an upward facing casing edge;

e. rotating and lowering said casing mill to engage said cutout arms on said upward facing casing edge with a desired weight, while continuing pumping fluid therethrough, and cutting a window of sufficient length in said casing;

f. increasing rotation speed and weight on said casing mill so as to wear away said cutout arms to a radial dimension small enough for said cutout arms to enter said casing string;

g. rotating and lowering said casing mill to engage said cutters on said upward facing casing edge with a desired weight, while continuing pumping fluid therethrough, until a desired window length has been cut.

8. The method of claim 7, wherein said cutters are disposed on said cutter bases in a plurality of vertically spaced apart rows, and further comprising the steps of:

h. continuing rotation on said casing until a row of cutters wears sufficiently to drop fully within the string of casing being milled; and I. detecting when said row of cutters drops into said casing string by surface indicators.

9. The method of claim 8, further comprising the steps of:

j. determining the footage of casing milled by a row of cutters;

k. determining the footage of casing which can be milled on a given casing mill run using the footage milled by a row of cutters and the number of rows of cutters available.

* * * * *